United States Patent [19]

Galumbeck

[11] Patent Number: 4,662,015

[45] Date of Patent: May 5, 1987

[54] COMBINED FOUNDATION AND BEDSPREAD BENCH

[76] Inventor: Michael H. Galumbeck, 5577 Vantage Point Rd., Columbia, Md. 21044

[21] Appl. No.: 799,641

[22] Filed: Nov. 19, 1985

[51] Int. Cl.[4] ..... A47C 21/02; A47B 83/00

[52] U.S. Cl. ..... 5/504; 5/400; 5/2 R

[58] Field of Search ..... 5/504, 506, 507, 308, 5/58, 400, 11, 2 R, 200 R

[56] References Cited

U.S. PATENT DOCUMENTS

| | | | |
|---|---|---|---|
| 2,251,544 | 8/1941 | Jiranek | 5/308 |
| 2,299,136 | 10/1942 | Feldman | 5/11 |
| 2,599,246 | 6/1952 | Toomey et al. | 5/11 |
| 2,854,676 | 10/1958 | Fried et al. | 5/308 |
| 3,004,267 | 10/1961 | Pesola | 5/504 |
| 3,241,159 | 3/1966 | Reed | 5/504 |
| 3,546,725 | 12/1970 | Tambascio | 5/200 R |
| 3,605,141 | 9/1971 | Silverman | 5/400 |
| 3,828,376 | 8/1974 | Miller | 5/200 R |
| 4,186,452 | 2/1980 | Underwood | 5/400 |
| 4,535,494 | 8/1985 | Diamondstein | 5/400 |

FOREIGN PATENT DOCUMENTS

| | | | |
|---|---|---|---|
| 247204 | 5/1912 | Fed. Rep. of Germany | 5/504 |
| 3002926 | 7/1981 | Fed. Rep. of Germany | 5/507 |

*Primary Examiner*—Alexander Grosz

*Attorney, Agent, or Firm*—Bacon & Thomas

[57] ABSTRACT

A combined foundation and bedspread bench for supporting a mattress wherein the foundation includes an upper layer defined in part by a uniform support structure which extends to the perimeter of the upper layer, and a compartment disposed at the bottom portion of the foundation for storing the bench therein, the compartment and bench being structurally integral with the foundation.

4 Claims, 4 Drawing Figures

COMBINED FOUNDATION AND BEDSPREAD BENCH

BACKGROUND OF THE INVENTION

1. Field of the Invention

The present invention generally involves the field of technology pertaining to bed structures. More specifically, the invention relates to a bed assembly, including a mattress and foundation, provided with an extensible bench for supporting a bedspread or the like.

2. Description of the Prior Art

It is well known to provide a bed with a device for supporting the blanket or bedspread in an elevated position off the floor. This device may be in the form of either a permanent part of the bed structure or a removable attachment that is usually inserted between the mattress and foundation. A common characteristic of these devices resides in their capability of being extended into a position of use and retracted into a position of storage. The actual support surface may be defined by a rack or a planar shaped member supported for either telescopic or pivotal movement between the extended and retracted positions. While these devices generally do not alter the physical structure of either the mattress or the foundation, they do affect the support function of the bed if of the type which telescopes into a retracted storage position between the mattress and foundation. Examples of known devices of the aforedescribed types are disclosed by the Guilford U.S. Pat. No. 543,577, Richards U.S. Pat. No. 1,359,430, Cross U.S. Pat. No. 1,954,283, Ries U.S. Pat. No. 2,562,333, and Reed U.S. Pat. No. 3,241,159.

The prior art has also recognized that a compartment may be formed within the foot of a bed foundation for receiving a drawer within which bedclothes may be stored. This type of structure necessarily prevents the portion of the foundation defined by the compartment from being provided with the usual coil springs or equivalent resilient support means, thereby resulting in a foundation that is incapable of providing continuous and uniform support throughout the entire area of the mattress. Examples of known devices of this type are taught by the Cohn U.S. Pat. No. 2,271,388 and Zuk U.S. Pat. No. 2,538,549.

SUMMARY OF THE INVENTION

It is an object of the invention to provide an improved mattress foundation having an associated bedspread bench, wherein the foundation is capable of providing continuous and uniform support for the entire area of an overlying mattress.

It is another object of the invention to provide an improved foundation having a bedspread bench integrally formed therewith for concealed storage within the foundation.

It is a further object of the invention to provide an improved foundation that is structurally integrated with a bedspread bench that may be extended into a position of use and retracted into a position of storage.

These and other objects of the invention are realized by providing an improved foundation having a continuous and uniform upper support layer and a compartment integrally formed as a part of the lower portion of the foundation, and positioned at the foot thereof. The compartment includes a pair of telescopic rails on which a bench is supported and permitted to be extended into a position of use or retracted into a position of storage within the compartment. The bench is supported by two pairs of pivotal linkages which permit the bench to be elevated vertically with respect to the rails when the bench is disposed into the extended position of use. The linkages also permit the bench to be folded downwardly towards the rails to form a compact assembly for retraction within the compartment and concealed from view by a facing which forms a part of the lower perimeter of the foundation. The pivotal linkages are preferably spring biased to facilitate initial elevation of the bench, with means being provided for locking the bench in both its elevated and folded positions. The upper support layer of the foundation is preferably defined by a plurality of internal coil springs that are uniformly spaced throughout the foundation to the perimeter thereof.

Other objects, features and advantages of the invention shall become apparent from the following detailed description of a preferred embodiment thereof when viewed in conjunction with the drawings wherein like reference characters designate corresponding parts of the several views.

DETAILED DESCRIPTION OF THE PREFERRED EMBODIMENT

Figure 1:
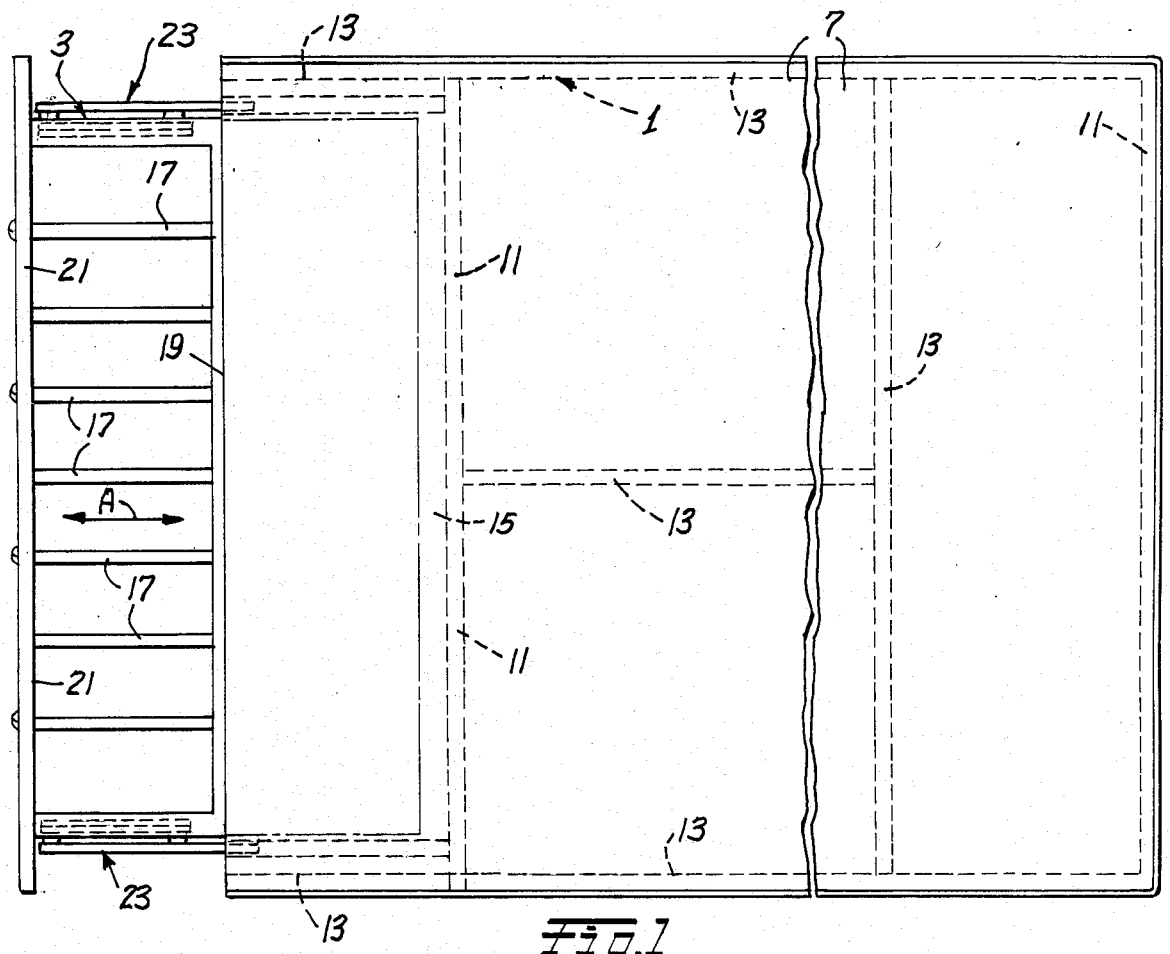
FIG. 1 is a fragmentary plan view of a combined foundation and bedspread bench according to a preferred embodiment of the invention, shown with a mattress supported on the foundation and the bench disposed in an extended position of use.

A foundation 1 provided with a combined bedspread bench 3 according to a preferred embodiment of the invention shall now be described with initial reference to FIGS. 1 and 2. As shown therein, foundation 1 is preferably of a rectangular configuration and includes an upper layer 5 on which a conventional mattress 7 may be supported. Upper layer 5 is in the form of a continuous and uniform support structure which extends substantially to the perimeter of foundation 1, wherein such support structure is preferably defined by a plurality of spaced internal coil springs 9. It is understood that springs 9 may be of any conventional type well known in the art and deemed suitable for the practice of the invention as described herein. It is also contemplated that springs 9 may be substituted with other similar forms of resilient support structure that are commonly used in the construction of mattress foundations.

An important aspect of the invention resides in upper layer 5 being provided with a continuous and uniform support structure which provides full support for the entire area and extent of mattress 7 overlying layer 5. Thus, springs 9 or other suitable resilient support structure are internally disposed within upper layer 5 and extend substantially to the perimeter thereof so that reaction to the application of vertical forces is uniform across the entire extent of layer 5.

Foundation 1 also includes a lower portion 6 disposed beneath upper layer 5. Lower portion 6 is preferably constructed in the form of an open framework defined by a plurality of transverse beams 11 and a plurality of longitudinal beams 13. Beams 11 and 13 are preferably formed of wood, metal or other suitable material. The overall configuration of the open framework defined by beams 11 and 13 may of course be varied in any conventional manner deemed suitable for providing the structural characteristics required for the practice of the invention. A sheet 12, preferably of wood, overlies beams 11 and 13, and provides attachment support for the lower ends of springs 9.

A compartment 15 is formed at one end of lower portion 6, which end is traditionally designated as the foot of a bed assembly collectively defined by foundation 1 and mattress 7. Compartment 15 extends transversely across lower portion 6 for substantially the entire width thereof. It is further important to note that the sides and top of compartment 15 are basically formed from beams 11, 13 and the lower surface of sheet 12, thereby making compartment 15 a structurally integral portion of foundation 1. It should further be noted that compartment 15, being disposed within lower portion 6, is positioned entirely beneath upper layer 5, thereby in no way adversely affecting the otherwise continuous and uniform support provided by layer 5 for mattress 7.

Figure 2:
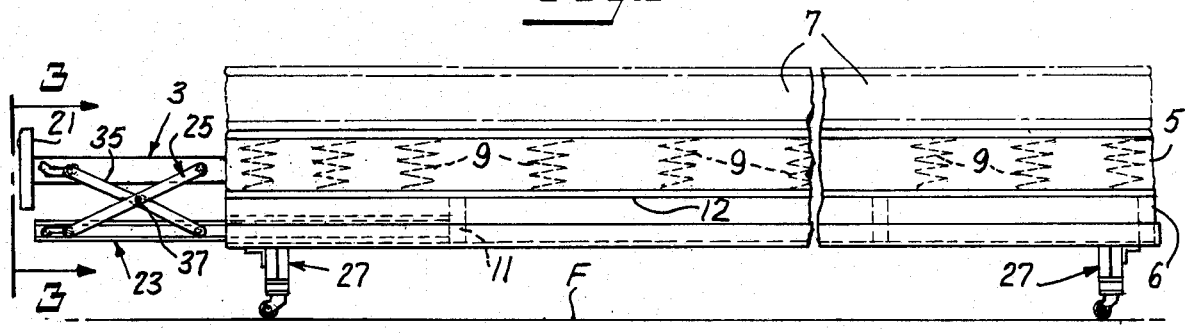
FIG. 2 is a side elevational view of FIG. 1 depicting the bench in its vertically elevated position with respect to its associated telescopic rails.

As also shown in FIGS. 1 and 2, bench 3 is preferably defined by a plurality of transverse slats 17, a longitudinal slat 19 and a longitudinal outer facing 21. Bench 3 is structurally connected to foundation 1 by a pair of opposed telescopic rail assemblies 23, with each rail assembly 23 being directly connected to bench 3 through a pair of pivotal linkages 25. This arrangement permits bench 3 to be vertically elevated, as shown in FIG. 2, and downwardly folded against rail assemblies 23 for retraction and storage within compartment 15. The movement of bench 3 during its extension or retraction by means of rail assemblies 23 is depicted in the opposite directions indicated by double arrow A shown in FIG. 1.

It is also preferred that foundation 1 be supported above floor level F and rendered transportable thereon by a plurality of caster assemblies 27 of conventional construction.

Figure 3:
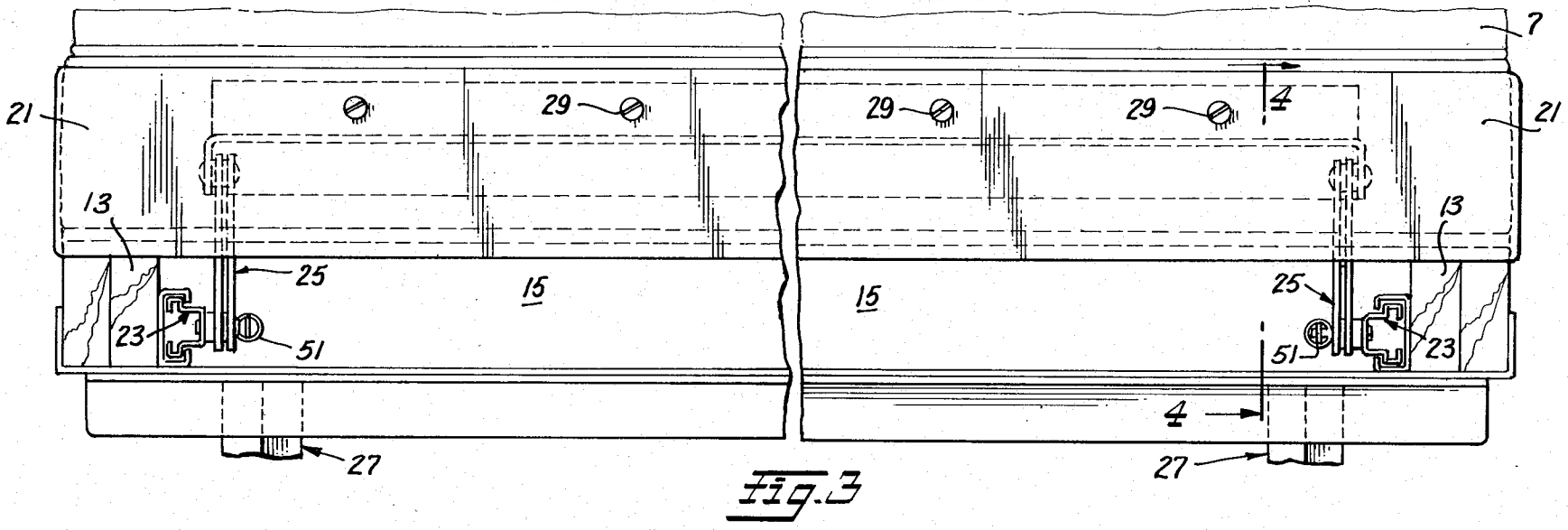
FIG. 3 is an enlarged fragmentary elevational view taken along the line 3—3 of FIG. 2.

The details of bench 3 shall now be described with particular reference to FIGS. 3 and 4. As previously indicated, the exterior longitudinal edge of bench 3 is defined by facing 21 which may be in the form of a strip of wood or other decorative molding that presents both a visual and structural continuation of the lower perimeter of foundation 1 when bench 3 is in its fully stored position within compartment 15. Facing 1 may be secured to bench 3 by a plurality of screws 29 or other suitable fastening means.

Figure 4:
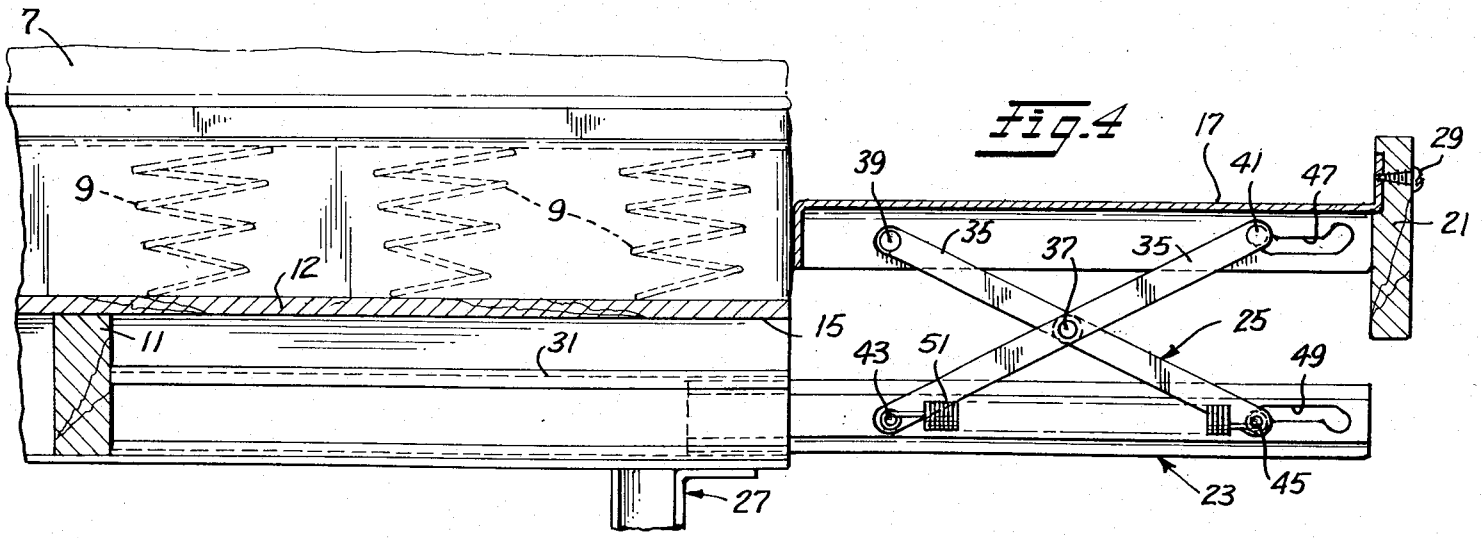
FIG. 4 is a fragmentary vertical sectional view, taken on the line 4—4 of FIG. 3.

As more clearly shown in FIG. 4, each rail assembly 23 includes a stationary elongate socket 31 that is rigidly secured to a longitudinal beam 13 defining a side wall of compartment 15, and an extensible elongate member 33 which is telescopically received within socket 31. Each linkage assembly 25 includes a pair of elongate links 35 which are connected for pivotal movement at their midpoints by means of a rivet 37 or other suitable mechanical fastener. The corresponding upper ends of links 35 are each pivotally connected to an outer side slat 17 of bench 3 through a pair of rivets 39 and 41 or other suitable mechanical fasteners. Similarly, the corresponding lower ends of links 35 are also pivotally connected to extensible member 33 by a pair of rivets 43 and 45 or other suitable mechanical fasteners. It should be noted that rivet 41 is slidably disposed within a horizontal slot 47 formed in slat 17, with slot 47 being provided with upwardly diverging end portions which permit rivet 41 to be locked in either one of two positions. Similarly, extensible member 33 is also provided with a corresponding horizontal slot that includes a pair of downwardly diverging end portions which permit rivet 45 to be locked in either one of two positions. Each extensible member 33 also carries a coil spring 51 having its opposite ends secured to rivets 43 and 45. The structural features described herein for linkage assemblies 25 and rail assemblies 23 are the same for both ends of bench 3.

MODE OF OPERATION

The manner in which bench 3 is retracted and extended with respect to compartment 15 of foundation 1 shall now be described with reference to the drawings, and particularly FIG. 4. The position of bench 3 with respect to foundation 1 as shown in FIG. 4 comprises the extended position of use wherein bench 3 has also been disposed in its fully elevated position with respect to rail assemblies 23. In this position, rivets 41 and 45 of each linkage assembly 25 are securely locked within their corresponding internal end portions of slots 47 and 49, respectively. Bench 3 is therefore rigidly supported in this elevated position for receiving bedspreads, blankets or the like. Springs 51 remain in their fully contracted untensioned state when bench 3 is in this position.

The retracting and storing of bench 3 within compartment 15 is accomplished by moving rivets 41 and 45 of each linkage assembly 25 into the main portions of horizontal slots 47 and 49, respectively, and thereafter folding bench 3 downwardly toward rail assemblies 23 against the action of springs 51 which undergo corresponding extension. Continued folding of bench 3 in this manner eventually causes rivets 41 and 45 to be disposed within and locked in the outer end portions of slots 47 and 49, respectively. This constitutes the fully folded position of bench 3 wherein the lower portion of facing 21 overlaps the outer ends of rail assemblies 23 and the upper surface of bench 3 is positioned at a level below the lower surface of sheet 12. Thereafter, bench 3 may be simply pushed into compartment 15, thereby causing extensible members 33 to telescope within their corresponding socket members 31. When bench 3 has been fully disposed within compartment 15, facing 21 is positioned adjacent lower portion 6 of foundation 1 and serves to completely conceal bench 3 and its associated hardware.

It is therefore apparent that notwithstanding the retraction of bench 3 into its position of storage within compartment 15 or the extension of bench 3 into its position of use, the continuous and uniform support provided by upper layer 5 of foundation 1 for mattress 7 is in no way affected. Moreover, the integration of bench 3 as a structural part of foundation 1 affords both a smooth operation of bench 3 and an unobtrusive attractive appearance of bench 3 in its extended and retracted positions.

It is to be understood that the form of the invention herein shown and described is to be taken as merely a preferred embodiment of the same and that various changes in shape, material, size and arrangement of parts may be resorted to without departing from the spirit of the invention or scope of the subjoined claims.

I claim:

1. A combined foundation and bedspread bench comprising:

(a) a foundation including an upper layer for supporting a mattress thereon and a lower portion;

(b) the upper layer being defined by a substantially continuous and uniform internal support structure;

(c) the lower portion including a framework formed from a plurality of longitudinal and transverse beams which partly define a compartment disposed therein and integrally formed therewith;

(d) a bench having a planar support surface carried by the lower portion for supporting a bedspread thereon;

(e) a pair of spaced telescopic rail assemblies supporting the bench for movement between an extended position wherein the bench is disposed out of the compartment, and a retracted position wherein the bench is stored within the compartment;

(f) pivotal linkage means connecting the bench to the rail assemblies for permitting the bench to be moved vertically between an elevated position of use and a folded position when the bench is disposed in the extended position;

(g) means for locking the bench in the elevated position;

(h) means for maintaining the bench in the folded position when the bench is disposed in the extended position; and (i) resilient means for biasing the bench towards the elevated position.

2. The combined foundation and bedspread bench of claim 1 further including a facing carried by the bench for concealing the bench when the bench is stored within the compartment.

3. The combined foundation and bedspread bench of claim 1 wherein the support surface of the bench is defined by a plurality of spaced slats.

4. The combined foundation and bedspread bench of claim 1 further including a plurality of castor assemblies for supporting the foundation in a raised position and transporting same.

* * * * *